US005414438A

United States Patent [19]

Dooley

[11] Patent Number: 5,414,438

[45] Date of Patent: May 9, 1995

[54] SPACE LATTICE PASSIVE REPEATER

[76] Inventor: John A. Dooley, P.O. Box 161, East Marion, N.Y. 11939

[21] Appl. No.: 120,861

[22] Filed: Sep. 13, 1993

[51] Int. Cl.[6] ..... H01Q 15/02; H01Q 15/24

[52] U.S. Cl. ..... 343/910; 343/909

[58] Field of Search ..... 343/910, 909, 911 R, 343/907, 908, 756; H01Q 15/02, 15/24

[56] References Cited

U.S. PATENT DOCUMENTS

| | | | |
|---|---|---|---|
| 2,577,619 | 12/1951 | Kock | 343/910 |
| 2,599,763 | 6/1952 | Kock | 343/910 |
| 2,608,659 | 8/1952 | Korman | 343/910 |
| 3,144,606 | 8/1964 | Adams et al. | 343/910 |
| 5,181,043 | 1/1993 | Cooper | 343/713 |

*Primary Examiner*—Donald Hajec
*Assistant Examiner*—Hoanganh Le

[57] ABSTRACT

The Space Lattice Passive Repeater redirects radio waves in two directions, directly opposite to each other, and both perpendicular to the original path of radio wave propagation. The redirected radio waves, in the perpendicular paths, are polarized differently, by ninety degrees, from the original radio wave. The device is composed of an array of thin, stacked, metallic, plates, insulated from each other, whose vertical spacing, between the plates, is computed from the operating wavelength, the ratio of the moist adiabatic lapse rate to the dry adiabatic lapse rate, Bragg's Law, and its' derivatives.

1 Claim, 2 Drawing Sheets

SPACE LATTICE PASSIVE REPEATER

BRIEF SUMMARY OF THE INVENTION

The objective of the Space Lattice Passive Repeater is to provide a simple device that redirects radio frequency waves in two directions, directly opposite to each other, and both perpendicular to the original path of radio wave propagation, i.e. it splits the path of the original radio wave propagation into a "tee." Additionally, the redirected radio waves, in the perpendicular paths, will be polarized differently, by ninety degrees, from the original radio wave, shifted either from a vertical to a horizontal polarization, or from a horizontal to a vertical polarization. The device is composed of thin, stacked, metallic, plates, that are insulated from each other, whose vertical spacing has been experimentally determined to produce the effects previously stated. The principles employed by this device are found in the natural phenomena of radio wave propagation by elevated duct, and Fraunhofer diffraction, by three dimensional grating, or space lattice, as set forth in Bragg's Law. Three dimensional diffractive gratings, or space lattices, employing crystals, or crystal powders, were developed for the analysis of electromagnetic waves of very short wavelengths, namely x-rays, while this device redirects radio waves, which are electromagnetic waves of relatively long wavelength. The thin, stacked, metallic, plates alter the vertically, or horizontally, polarized radio wave, by exactly ninety degrees, by placing the principle plane of incidence of the radio wave to the plates along the horizontal axis of the electromagnetic wave. This slows the propagation of the horizontal component of the wave by passing it through the denser, conductive, metal versus the vertical component, perpendicular to it, which passes through less dense air, thus effecting the change in polarization. The alterations in the direction of propagation, i.e. two paths perpendicular to the original path of propagation, is accomplished by the phase difference introduced by the spacing between the plates, closely correlated to that necessary to produce a super-refractive bending effect. The uniqueness of this passive repeater lies in the fact that, unlike passive repeaters of the reflector type, either billboard or periscope, or the back to back type, which only redirect radio waves point to point, the Space Lattice Passive Repeater allows them to be redirected from multipoint to multipoint. Also, unlike existing passive repeaters, two independently operating radio wave transmitters can simultaneously use the Space Lattice Passive Repeater, without causing mutually harmful interference.

Figure 2:
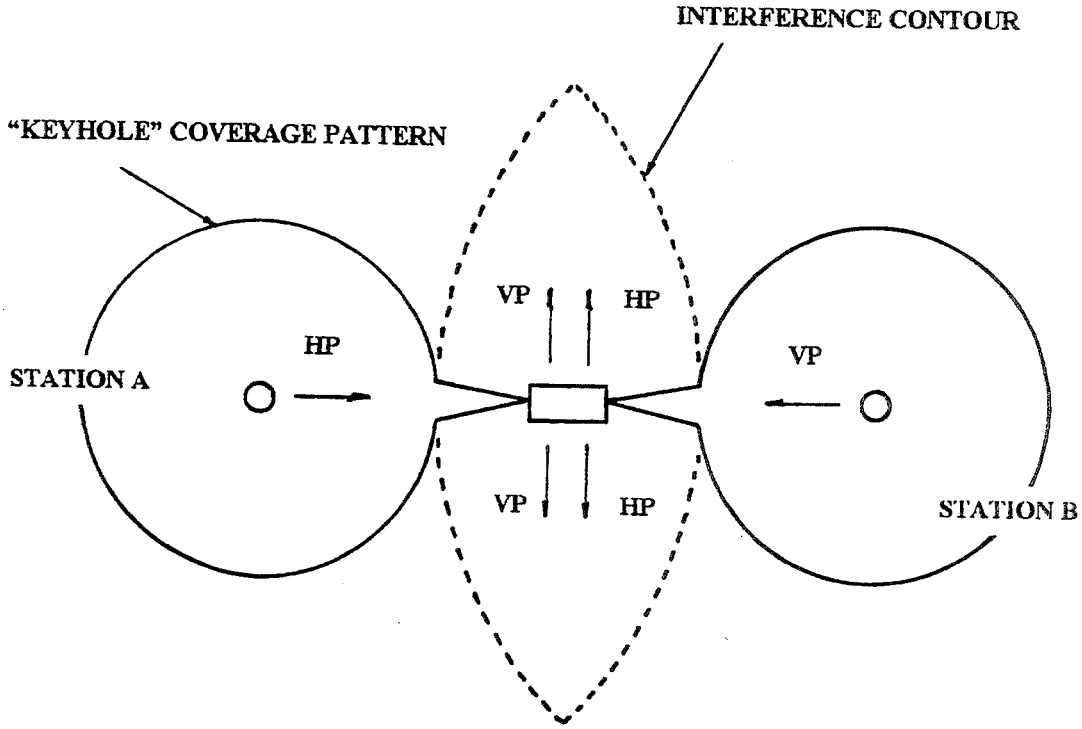

Basic representation of the Space Lattice Passive Repeater highlighting the spacing between the metallic plates FIG. 2—Frequency Reuse By Closely Spaced Radio Transmitting Stations (Plan View)

Figure 3:
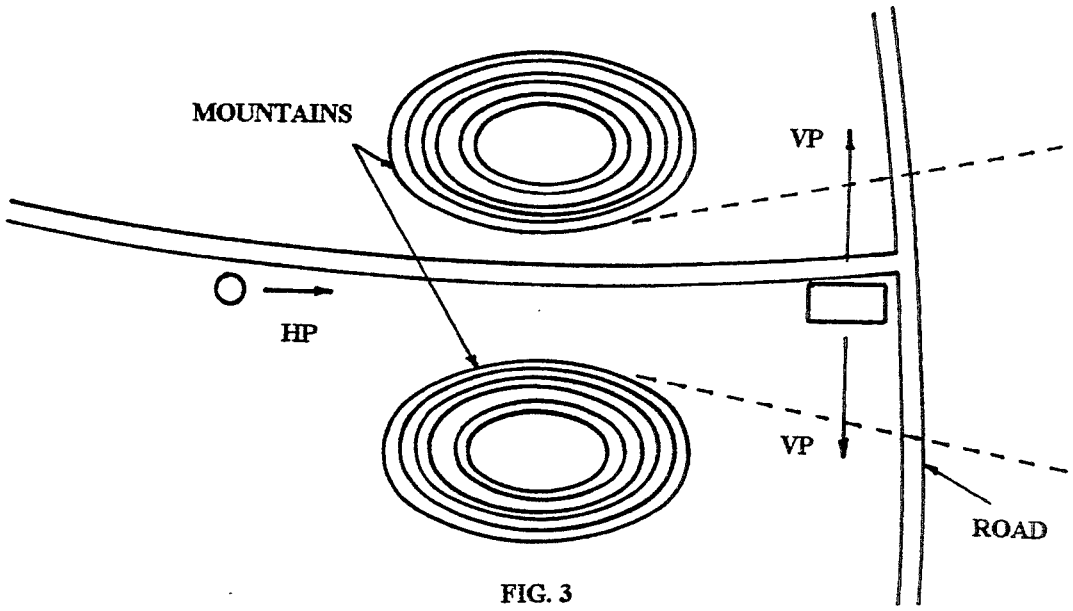

Basic representation of the coverage patterns necessary to be used, with the Space Lattice Passive Repeater, in order to avoid mutual, harmful, interference, between the radio transmitting stations, within the normal interference contour FIG. 3—Extending Radio Coverage Behind An Obstruction (Plan View)

Basic representation of how the Space Lattice Passive Repeater is used to extend radio coverage into the "shadow" zone created by an obstruction, such as mountains

DETAILED DESCRIPTION

The first step in the creation of the Space Lattice Passive Repeater was to establish the optimum vertical spacing, between the plates, to create an elevated, super-refractive, duct for radio wave propagation. Such a duct would tend to bend, and concentrate, radio energy towards the center of the vertical spacing, and parallel to the metallic plates. The determination of this optimum vertical spacing, between the plates, was taken from the ratio of the moist adiabatic lapse rate of a 3.3° F. decrease in air temperature, per one thousand feet of altitude, and the dry adiabatic lapse rate of 5.4° F. decrease in air temperature, per one thousand feet of altitude. Solving this ratio produced a resultant of 0.6111. Since most of the experimentation on this naturally occurring, elevated, ducting phenomena was conducted on the Novice portion of the Ten Meter Amateur Radio Band, I will select, as an example, the radio carrier frequency of 28.36 Megahertz, which has a wavelength of 34.7 feet. Through experimentation, the optimum vertical separation, between the plates, to produce the elevated ducting effect was derived as follows:

Taking 34.70 Feet (.6111) = 21.21 Feet
21.21 Feet (.6111) = −12.96 Feet
8.25 Feet Optimum Vertical Spacing The antennas of most radio transceivers are either vertically polarized (the electric component of the electromagnetic wave is perpendicular to the earth's surface), or horizontally polarized (the electric component of the electromagnetic wave is horizontal to the earth's surface), with the magnetic component of the electromagnetic wave always perpendicular to the electric component. Thus an array of thin, stacked, metallic, plates, insulated from each other, with the flat, wide, surface of the plates oriented parallel to the earth's surface, will place the plane of incidence, of the radio wave to the plates, along the axis of one of the two components of the electromagnetic wave. This configuration will alter the polarization of the radio wave by exactly ninety degrees, thereby changing a vertically polarized signal to a horizontal, and vice-a-versa, according to well established principles of the velocity of wave propagation in air and conductive media. In effect, the velocity of propagation of the horizontal component, of the electromagnetic wave, is slowed by the denser, conductive, metallic plate, relative to the vertical component, perpendicular to it, which passes through less dense air. The effect, well known from a certain type of microwave lens, is to straighten the curved wavefront, of the radio wave, which is maintained perpendicular to the plates by the super-refractive bending quality of the Space Lattice Passive Repeater.

Recognizing that thin, stacked, metallic, plates, insulated from each other, can emulate a three dimensional diffractive grating, or space lattice, such as the planes of the lattice structure of crystals, we can employ Bragg's Law to determine the phase difference, and change in direction of propagation, introduced by this device, after the alteration in polarization takes place. Since the straightened wavefront is held perpendicular to the plates, the angle of incidence will be considered ninety degrees. Now we can determine the phase difference, introduced by the spacing between the plates, by Bragg's Law and its' derivatives:

The first step is to determine M d=vertical spacing between the plates $\Theta$=angle of incidence M=multiple of the wavelength $\lambda$=wavelength $2d \sin \Theta = M\lambda$ $2(8.25) \sin 90° = M\ (34.7)$ $(16.5)\ 1.00 = M\ (34.7)$ $16.5 = M\ (34.7)$ $16.5/34.7 = M$ $0.476 = M$ Normally, employing Bragg's Law, M is a whole number, because the wavelengths employed are smaller than the vertical spacing of the of the lattice structure. Here the wavelengths used are larger than the vertical spacing of the lattice structure.

The next step is to determine the phase difference introduced:

$\partial$=phase difference $\pi$=pi $\pi/2$=90 degrees $\pi/2\ (2M\pi) = \partial$ $\pi/2(3) = \partial$ $3\pi/2 = \partial$, or 270 degrees Thus the direction of altered propagation is established perpendicular to the original path of propagation, radiating out the open vertical spaces between the plates.

The experimental observations, that led to the previously stated conclusions, were conducted over several years, by analyzing contacts made between European amateur radio stations, and an amateur radio station in East Marion, N.Y. (eastern tip of Long Island), on the Ten Meter Band. Contacts, on this band, can normally be expected when ionospheric conditions, for the propagation of Ten Meter radio frequencies, are optimal. Since the normal mode of propagation, on this band, is through reflections off the ionosphere, the overwhelming number of Ten Meter radio stations employ horizontally polarized antennas. However, the experimental Ten Meter station, in East Marion, uses a vertically polarized antenna. Being cross-polarized in this manner, a very few, very weak, very sporadic contacts would be normally expected between East Marion and Europe. However, a pattern of contacts emerged that were relatively frequent, and strong, usually occurring when the conditions for ionospheric propagation were unfavorable. Also, when dropouts occurred, during a contact, they would be abrupt, rather than a slow fade, as is usual in ionospheric propagation. Additionally, radio wave propagation, over long distances, follows the great circle route. Employing radio direction finding equipment, I established the signal as originating due south of East Marion—the wrong way for Europe. Examination of the existing literature found that this last phenomena has been previously observed, by others, and termed "side scatter," with a convoluted attempt being made to explain it as a unique form of ionospheric propagation. Rejecting "side scatter" as too implausible, I continued making intensive local observations of weather conditions when the phenomena occurred. I found that this mode of propagation occurred when a narrow band of white, puffy, clouds, with dark bottoms, formed in a line running east-west, over the ocean, perpendicular to the path of radio wave propagation established by radio direction finding. Now believing that the propagation effect was related to specific weather conditions, I began to collect weather data for all the dates such contacts were made. Certain local weather conditions were found to be in common, for all the dates, and are as follows:

1) As established by satellite, sea water, surface temperature charts, the above mentioned cloud formation followed a band of sea surface temperatures of 19° C., when:

a) air temperature≈surface water temperature b) relative humidity was a dry reading, for this area, of about 35% c) barometric pressure≈sea level reading of 29.92 inches of mercury d) wind was blowing on shore from the south, or southeast, at 10 to 15 knots 2) These conditions proved to be the ones favorable to the formation of band of thin, flat, microscopic, hexagonal, ice crystals, formed around a sea salt nuclei (the dark bottoms of the cloud formation). This particular type of ice crystal forms when the air temperature is between 25° F. and 32° F.

3) The maximum altitude (vertical spacing) covered by such a band of ice crystals is determined as follows:

$$\begin{array}{r} 32°\ \text{F.} \\ \underline{-25°\ \text{F.}} \end{array}$$

7° F./3.3° F. Moist Adiabatic Lapse Rate = 2,121 Feet Of Altitude

Obviously, to achieve this maximum altitude the dew point of the air must be reached at 32° F., thus the requirement for a relatively dry air at the sea surface. With air and sea surface temperature roughly equal, and barometric pressure "standard" for sea level, with a wind foaming out sea salt nuclei, we can employ the dry adiabatic lapse rate to calculate the lower altitude at which these ice crystals begin forming as follows:

$$(19°\ \text{C.} + 17.78)\ 1.8 = \begin{array}{r} 66.2°\ \text{F.} \\ \underline{-32.0°\ \text{F.}} \\ 34.2°\ \text{F.} \end{array}$$

34.2° F./5.4° F. Dry Adiabatic Lapse Rate = 6,333 Feet Of Altitude

Such an altitude places the ice crystal formation well within the radio coverage area of the East Marion experimental station, although the formation is over the ocean.

4) Now the vertical height of the ice crystal formation, under study, equals one hundred times the wavelength of the operating frequency times 0.6111.

34.7 (100)=3,470 Feet (0.6111)=2,121 Feet

5) The ice crystal formation is therefore the equivalent of one hundred (100) Space Lattice Passive Repeaters vertically stacked one upon another. Remembering my earlier computations, we see that the (d) distance, between the plates, had been initially determined as follows:

34.70 Feet (.6111) = 21.21 Feet
21.21 Feet (.6111) = −12.96 Feet
8.25 Feet

Further, we saw that 2d had to equal the multiple (M) of 0.476 of the wavelength (λ or 16.50 Feet (1d=0.238). Therefore, the final vertical separation, between the plates, to complete the Space Lattice Passive Repeater, must be determined as follows:

.611−.476: .135×wavelength (λ) 34.7 Feet: 4.71 Feet 1d is equal to 8.25 feet; plus 4.71 feet is equal to 12.96 feet. 12.96 feet divided by 8.25 feet is equal to 1.57, or pi divided by 2. Returning to the formula, derived from Bragg's Law we see that: 1.57 [360° (16.50/34.7)]
270∂

In summary, the spacings between the plates, of this particular Space Lattice Passive Repeater, are as follows:

4.71 Feet, or .135 × wavelength (λ) 34.7 Feet
8.25 Feet, or .238 × wavelength (λ) 34.7 Feet
8.25 Feet, or .238 × wavelength (λ) 34.7 Feet
21.21 Feet, or .611 × wavelength (λ) 34.7 Feet

[Note: 2 (8.25 Ft.) = 16.50 Ft. = M = .476 × wavelength (λ)]

6) Now an objection could be made that the thin, stacked, metallic, plates of the Space Lattice Passive Repeater, although they correspond to the planes of the crystal lattice structures employed by Bragg, do not correspond to the thin, flat, primitive, microscopic, hexagonal, ice crystals of the natural formation. However, the work of Debye and Scherrer, and A. W. Hull, showed that powdered crystals, i.e., a mass of small, randomly oriented crystals perform similarly to the lattice structure of a large crystal.

Following these experimental observations, I built a model of the Space Lattice Passive Repeater, which duplicated these results. The model further allowed a determination that the "repeated" signals produced approximately 20 db of isolation between an originally horizontally polarized signal, and an originally vertically polarized signal, and vice-a-versa. This amount of isolation is typical for cross-polarized signals.

Figure 1:
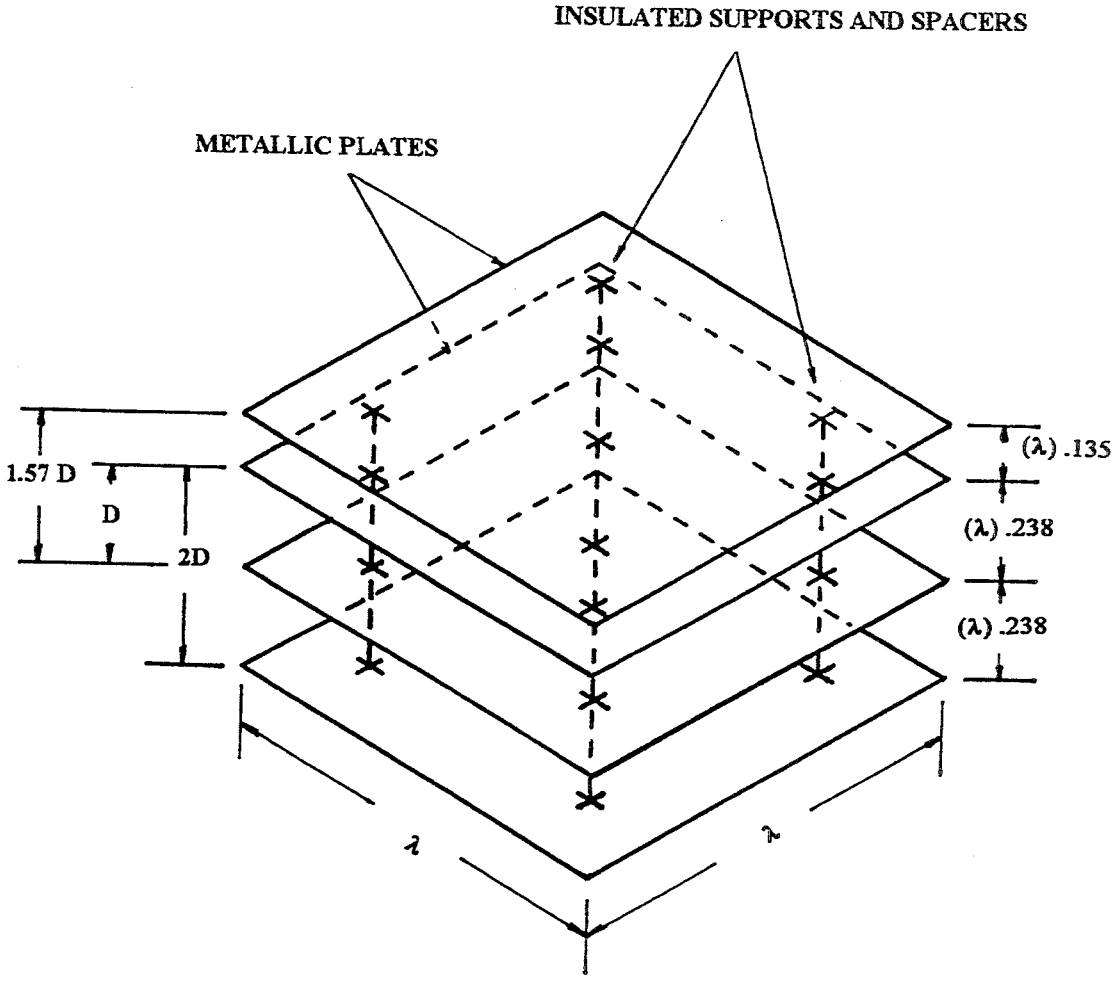
FIG. 1—The Basic Building Block Of The Space Lattice Passive Repeater (Perspective View)

To summarize, the Space Lattice Repeater (the basic building block of which is illustrated in FIG. 1) is constructed of thin, metallic plates, only thick enough to prevent sagging, and excessive vibration in the wind. The vertical spacing between the plates, to produce the desired phase difference of the passive repeater, is calculated as follows:

Distance from the bottom to the second plate=-wavelength (λ) x 0.238

Distance from the second to the third plate=-wavelength (λ) x 0.238

Distance from the third to the top plate=wavelength (λ) x 0.135

The thin, metallic, plates are oriented in the horizontal plane, stacked one above the other, by the calculated vertical spacing, separated by supports and spacers of insulating materials. The amount of insulating support and spacing materials should be the minimal to structurally support the passive repeater. The horizontal orientation is of course aimed at producing the initial cross-polarization. The number of repeaters to be stacked vertically depends on the gain desired, the distance to be covered, and the restraints of cost, size, zoning, and construction. In general, the most stacked repeaters, that are possible to be provided, are the most desirable. The length and breath of the plates face similar restraints. Minimally, they should be the wavelength, with the greatest multiple, of that length, possible being provided perpendicular to the widest area of coverage being desired. Finally, it should be noted that the Space Lattice Passive Repeater has a rather broadbanded frequency response. Therefore, all my calculations have been rounded off, in order to illustrate certain theoretical points more clearly.

A primary usage for the Space Lattice Passive Repeater is to allow two radio stations, operating on the same carrier frequency, located relatively close to each other, to extend the coverage area of each station, without causing harmful interference to each other. The Space Lattice Passive Repeater, employing rectangular plates in this application, is to be placed at the highest elevation practical, close to the mid-point of a line drawn between the locations of the two stations. Since the device is passive, the location doesn't require utilities or good accessibility. Each of the radio transmitting stations will have their outputs fed to an antenna system, which combines an omni-directional pattern antenna (vertically polarized), with a directional pattern antenna, of the narrowest beamwidth possible, to produce a, so-called, "keyhole" coverage pattern. The directional pattern of one station must be vertically polarized, and the other must be horizontally polarized. Each directional antenna will be pointed to the narrow side of the rectangular plates, which are perpendicular to the path of propagation of both stations. Limiting the power fed to both the omni and the directional antennas allows the overlap coverage area, of both stations, to remain cross-polarized (20 db isolation), and the paths of propagation to remain parallel to each other, i.e. perpendicular to the original paths of propagation. This device allows the reuse of frequencies, by independently operating radio stations, without mutually harmful interference, at distances much closer than are possible now, without the sacrifice of the coverage area of each station. This application is illustrated in FIG. 2.

Another usage for the Space Lattice Passive Repeater is to allow a radio transmitting station to extend its coverage area behind an obstruction, such as a mountain. This application is illustrated in FIG. 3.

The Space Lattice Passive Repeater also has an application in "spoofing" radio direction finding equipment.

Finally, it can be used to enable propagation of radio signals normally dependent on ionospheric propagation, when conditions for that type of propagation are unfavorable.

We claim:

1. A space lattice passive repeater for redirecting radio frequency waves in two directions, directly opposite to each other and both perpendicular to the original path of radio wave propagation, said repeater comprising four square thin metallic plates, each of said plates aligned above each other and insulated from each other, the flat wide surfaces of the plates being oriented parallel to the earth's surface, the lengths of said plates being λ, the vertical spacing from the bottom plate to the second plate being 0.238λ, the vertical spacing from the second plate to the third plate being 0.238λ, and the vertical spacing from the third plate to the top plate being 0.135λ, where λ is the wavelength of the radio carrier frequency, and insulated spacers and supports being located between said plates, whereby the repeater redirects radio waves from multipoint to multipoint.

* * * * *